US007800317B2

(12) United States Patent
Kimura

(10) Patent No.: US 7,800,317 B2
(45) Date of Patent: Sep. 21, 2010

(54) DISCHARGE LAMP LIGHTING APPARATUS AND SEMICONDUCTOR INTEGRATED CIRCUIT

(75) Inventor: Kengo Kimura, Niiza (JP)

(73) Assignee: Sanken Electric Co., Ltd., Niiza-shi (JP)

( * ) Notice: Subject to any disclaimer, the term of this patent is extended or adjusted under 35 U.S.C. 154(b) by 358 days.

(21) Appl. No.: 12/030,520

(22) Filed: Feb. 13, 2008

(65) Prior Publication Data

US 2008/0231207 A1 Sep. 25, 2008

(30) Foreign Application Priority Data

Mar. 20, 2007 (JP) ..... 2007-072655

(51) Int. Cl.
*G05F 1/00* (2006.01)

(52) U.S. Cl. ..... 315/307; 315/291; 315/306

(58) Field of Classification Search ..... 315/160, 315/172, 177, 209 R, 210, 219, 246, 276, 315/283, 287, 291, 299, 300, 301, 302, 306, 315/307, 308, DIG. 4
See application file for complete search history.

(56) References Cited

FOREIGN PATENT DOCUMENTS

JP 2001-196196 7/2001

*Primary Examiner*—Douglas W Owens
*Assistant Examiner*—Jianzi Chen
(74) *Attorney, Agent, or Firm*—Oblon, Spivak, McClelland, Maier & Neustadt, L.L.P.

(57) ABSTRACT

A discharge lamp lighting apparatus includes switching elements to pass a current to a primary winding of a transformer and a capacitor, an oscillator to generate a triangular signal, an error amplifier to amplify an error voltage of a voltage corresponding to a current passed through a discharge lamp and receive a burst dimming signal that is a pulse signal to intermittently supply power to the discharge lamp, comparators to compare the error voltage with the triangular signal and generate PWM control signals that turn on/off the switching elements, respectively, a clamp circuit to clamp an output from the error amplifier so that the output from the error amplifier may not drop below a lower limit value of the triangular signal during an OFF period of the burst dimming signal, and breaking circuits to block the PWM control signals during the OFF period of the burst dimming signal.

4 Claims, 8 Drawing Sheets

DISCHARGE LAMP LIGHTING APPARATUS AND SEMICONDUCTOR INTEGRATED CIRCUIT

BACKGROUND OF THE INVENTION

1. Field of the Invention

The present invention relates to a discharge lamp lighting apparatus and a semiconductor integrated circuit that turn on a discharge lamp such as a cold cathode fluorescent lamp used for, for example, a liquid-crystal display device.

2. Description of the Related Art

FIG. 1 is a circuit diagram showing a discharge lamp lighting apparatus disclosed in Japanese Unexamined Patent Application Publication No. 2001-196196 and FIG. 2 is a view showing waveforms during a burst dimming operation of the apparatus according to the related art shown in FIG. 1. The apparatus of FIG. 1 conducts the burst dimming operation by changing ON/OFF intervals of a driving switching transistor 325 in a DC-DC converter 32 to alternate ON/OFF states of a discharge lamp (fluorescent lamp) 34.

According to the related art, a dimming pulse signal P1 is low during an ON period (lit-up state) of the burst dimming operation that conducts an intermittent oscillation operation to dim the discharge lamp 34. During the ON period in which the dimming pulse signal P1 is low, transistors 42 and 43 are OFF, and therefore, an inverting terminal of a comparator 323 receives a dead-time voltage DT1. An error signal ER becomes higher than the voltage DT1, and accordingly, the comparator 323 supplies a control signal CS to the transistor 325. This results in increasing an ON ratio of the transistor 325. Namely, a power supply period (duty) for the discharge lamp 34 gradually increases to perform a soft start action. The soft start action gradually increases voltage and current applied to the discharge lamp 34, to prevent an excessive stress on the discharge lamp 34.

During an OFF period (lit-out state) of the burst dimming operation, a current that is insufficient to turn on the discharge lamp 34 is passed through a transformer 331 arranged in an inverter (automatic) 33. This prevents a sharp change in current supplied to the transformer 331 when the discharge lamp 34 is turned on from the OFF state. As a result, a turn-on action during the burst dimming operation can quickly activate the discharge lamp 34 from the soft start action.

SUMMARY OF THE INVENTION

A discharge lamp such as a cold cathode fluorescent lamp (CCFL) has a characteristic that it is unable to conduct a normal glow discharge nor pass a normal discharge current to a positive column unless an applied voltage reaches a lighting start voltage. This, however, is not true when the discharge lamp is installed as a backlight of a liquid-crystal panel.

When the discharge lamp lighting apparatus of the related art shown in FIG. 1 is installed for a liquid-crystal panel, proximity capacitance of the panel in the vicinity of the discharge lamp 34 causes a one-side phoresis state in which the discharge lamp 34 emits light only around an electrode thereof even if a voltage applied to the discharge lamp 34 does not reach the lighting start voltage. The one-side phoresis state prevents a uniform surface brightness on the panel and deteriorates the power efficacy of the inverter 33. It is not preferable, therefore, to generate an output voltage to be applied to the discharge lamp 34 during an OFF period of the burst dimming operation.

The present invention provides a discharge lamp lighting apparatus and a semiconductor integrated circuit, capable of quickly turning on a discharge lamp from a soft start action and turning on/off the discharge lamp nearly at the duty of a burst dimming signal in an ON period of a burst dimming operation, and in an OFF period of the burst dimming operation, stopping power supply to surely suppress light emission of the discharge lamp.

A first aspect of the present invention provides a discharge lamp lighting apparatus for converting a direct current into an alternating current and supplying power to a discharge lamp. The apparatus includes a resonant circuit including a transformer, a capacitor connected to at least one of primary and secondary windings of the transformer, and an output end connected to the discharge lamp; a plurality of switching elements connected to both ends of a direct-current power source and configured to pass a current to the primary winding and capacitor of the resonant circuit; an oscillator configured to generate a triangular signal; an error amplifier configured to amplify an error voltage between a reference voltage and a voltage corresponding to a current passed through the discharge lamp and receive a burst dimming signal that is a pulse signal to intermittently supply power to the discharge lamp; comparators configured to generate PWM control signals to turn on/off the switching elements, respectively, according to the error voltage from the error amplifier and the triangular signal from the oscillator; a first clamp circuit configured to clamp an output from the error amplifier so that the output from the error amplifier may not drop below a lower limit value of the triangular signal during an OFF period of the burst dimming signal; and breaking circuits configured to block the PWM control signals provided by the comparators during the OFF period of the burst dimming signal.

A second aspect of the present invention provides a semiconductor integrated circuit for controlling a plurality of switching elements that supply power to a discharge lamp. The semiconductor integrated circuit includes an oscillator configured to generate a triangular signal; an error amplifier configured to amplify an error voltage between a reference voltage and a voltage corresponding to a current passed through the discharge lamp and receive a burst dimming signal that is a pulse signal to intermittently supply power to the discharge lamp; comparators configured to generate PWM control signals to turn on/off the switching elements, respectively, according to the error voltage from the error amplifier and the triangular signal from the oscillator; a first clamp circuit configured to clamp an output from the error amplifier so that the output from the error amplifier may not drop below a lower limit value of the triangular signal during an OFF period of the burst dimming signal; and breaking circuits configured to block the PWM control signals provided by the comparators during the OFF period of the burst dimming signal.

DESCRIPTION OF THE PREFERRED EMBODIMENT

Discharge lamp lighting apparatuses and semiconductor integrated circuits according to the embodiments of the present invention will be explained in detail with reference to the accompanying drawings.

First Embodiment

Figure 1:
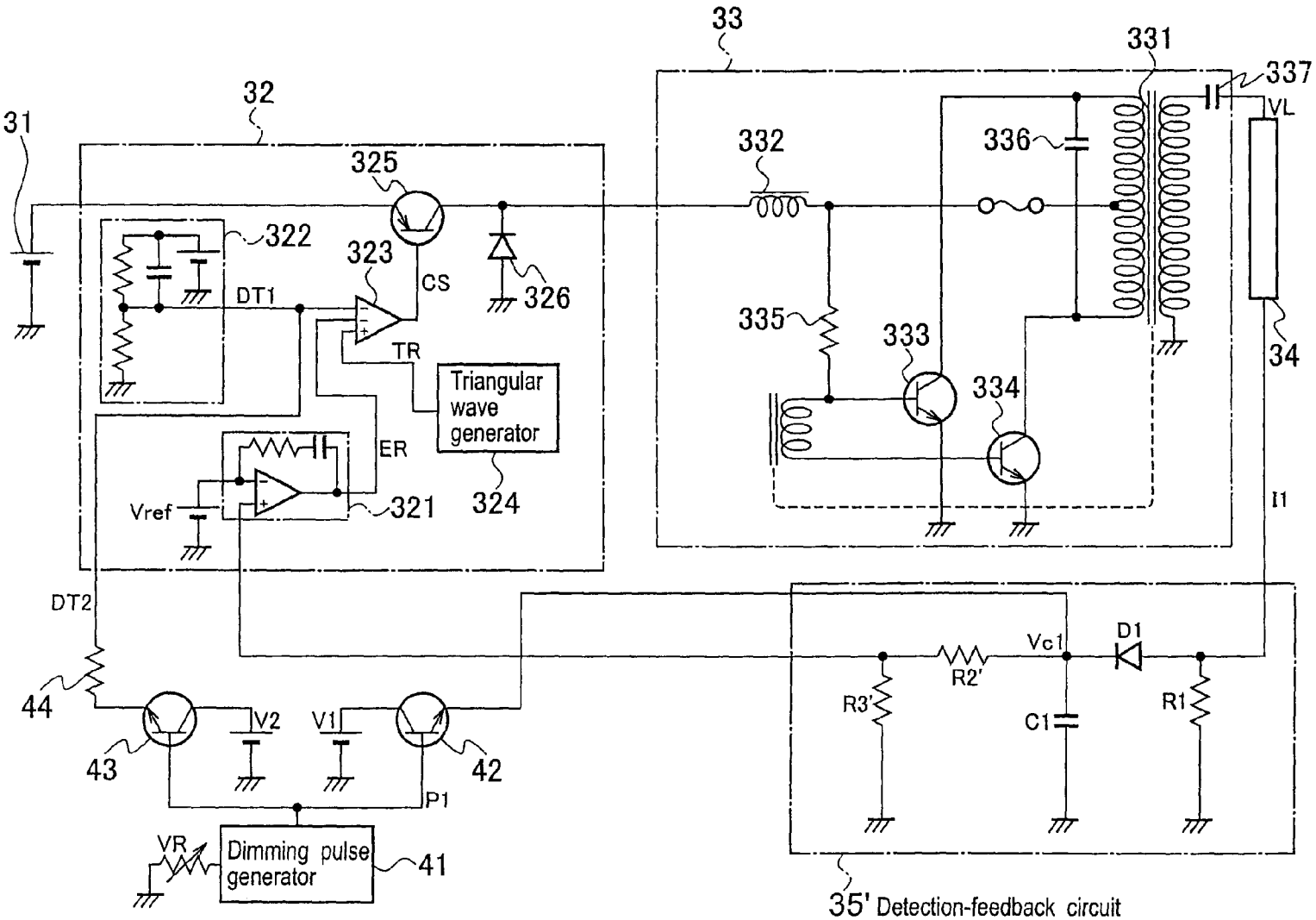
FIG. 1 Related Art
FIG. 1 is a circuit diagram showing a discharge lamp lighting apparatus according to a related art.
Figure 2:
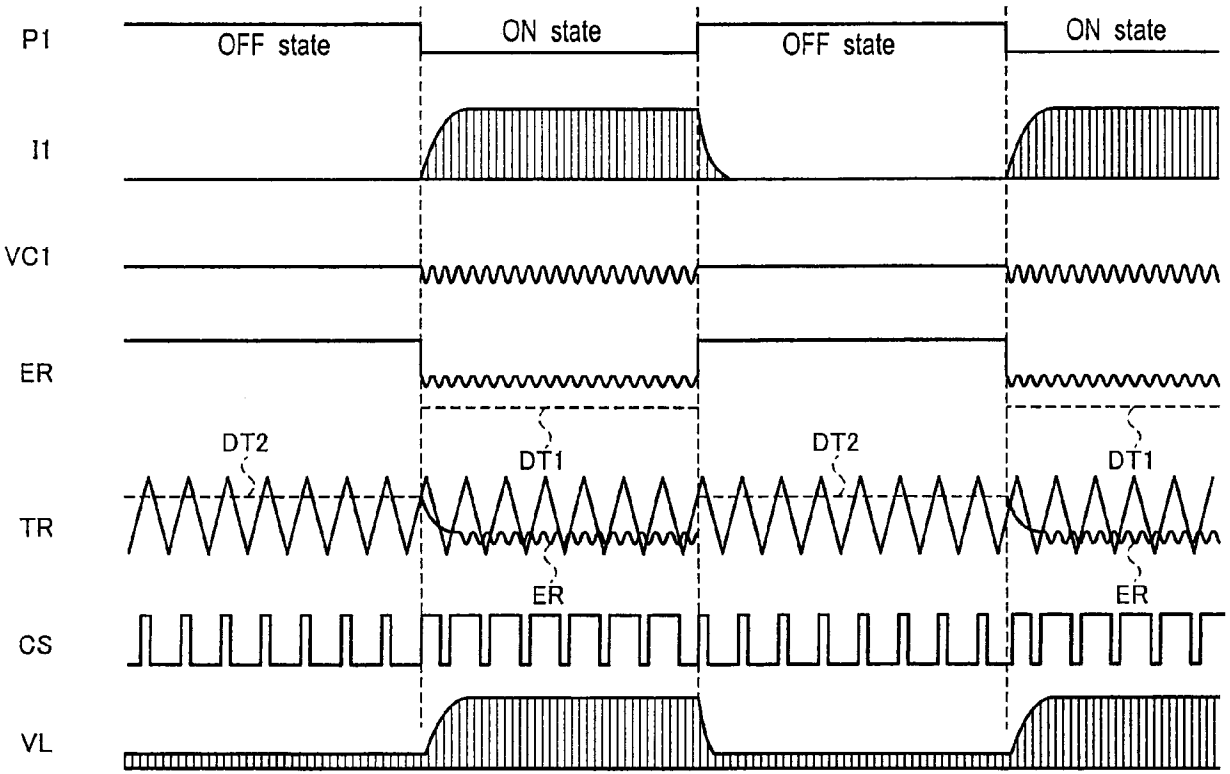
FIG. 2 Related Art
FIG. 2 is a view showing waveforms during a burst dimming operation of the apparatus according to the related art shown in FIG. 1.
Figure 3:
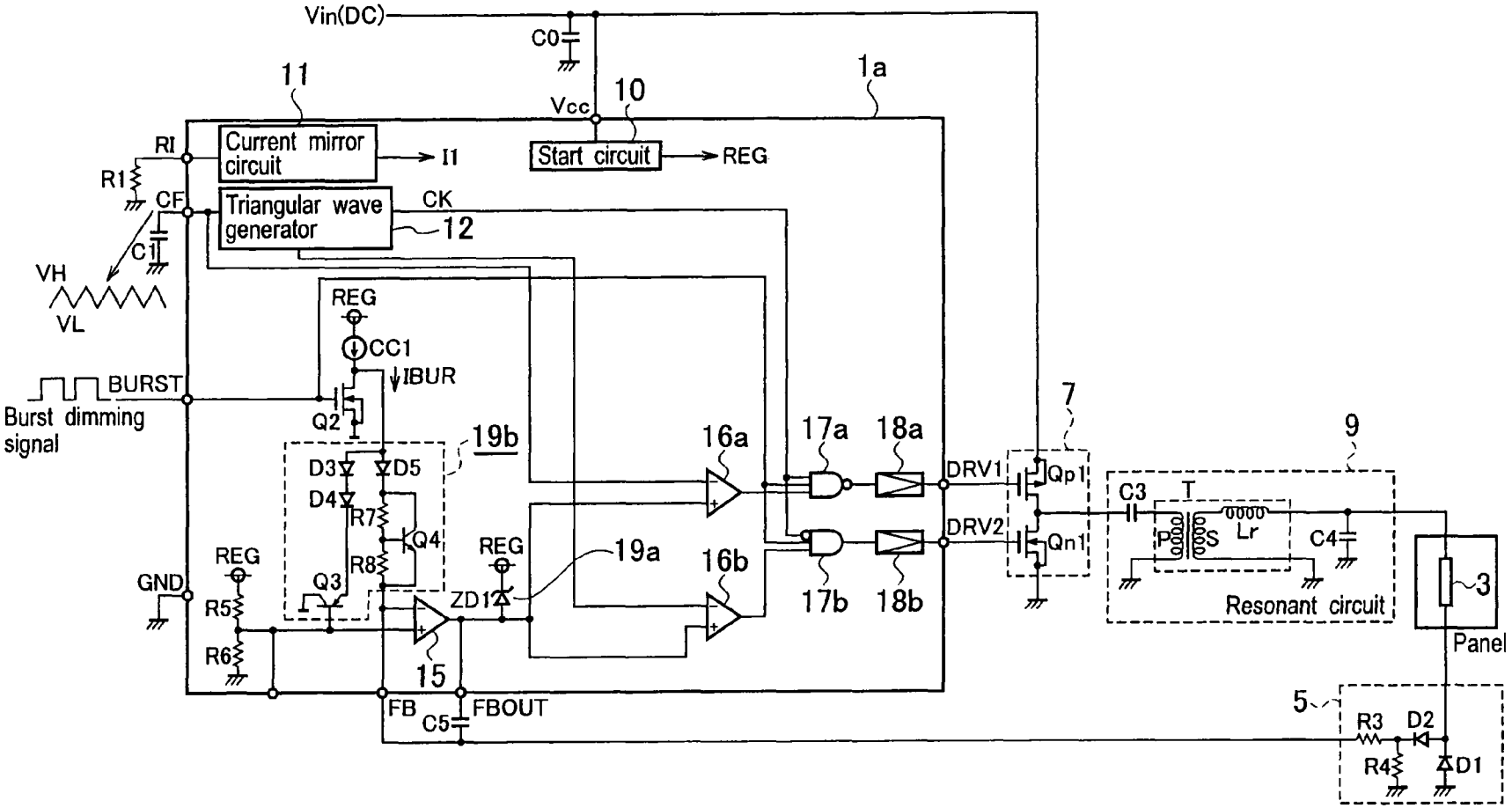
FIG. 3 is a circuit diagram showing a discharge lamp lighting apparatus according to a first embodiment of the present invention.

FIG. 3 is a circuit diagram showing a discharge lamp lighting apparatus according to the first embodiment of the present invention. In the apparatus shown in FIG. 3, a series circuit (switch network) 7 is connected between a DC power source Vin and the ground GND. The series circuit 7 includes a high-side p-type MOSFET Qp1 (hereinafter referred to as "p-type FET Qp1") and a low-side n-type MOSFET Qn1 (hereinafter referred to as "n-type FET Qn1"). Between a connection point of the p-type and n-type FETs Qp1 and Qn1 and the ground GND, there is a series circuit including a capacitor C3 and a primary winding P of a transformer T. Both ends of a secondary winding S of the transformer T are connected to a series circuit including a reactor Lr and a capacitor C4.

A source of the p-type FET Qp1 is connected to the DC power source Vin and a gate thereof is connected to a terminal DRV1 of a control circuit 1*a*. A gate of the n-type FET Qn1 is connected to a terminal DRV2 of the control circuit 1*a*.

The control circuit 1*a* includes a start circuit 10, a current mirror circuit 11, a triangular wave generator 12, an error amplifier 15, PWM comparators 16*a* and 16*b*, a NAND circuit 17*a*, a logic circuit 17*b*, and drivers 18*a* and 18*b*.

The current mirror circuit 11 is connected through a terminal R1 to one end of a constant current determination resistor R1. The triangular wave generator 12 is connected through a terminal CF to one end of a capacitor C1.

The start circuit 10 receives power from the DC power source Vin, generates a predetermined voltage REG, and supplies the voltage REG to various internal parts. The current mirror circuit 11 passes a constant current that is optionally set by the constant current determination resistor R1. With the constant current provided by the current mirror circuit 11, the triangular wave generator 12 charges and discharges the capacitor C1, to generate a triangular wave shown in FIG. 4 (which shows charge and discharge voltages of the capacitor C1 at the terminal CF). Based on the triangular wave, the triangular wave generator 12 generates a clock signal CK. The clock CK has a pulse voltage waveform that is synchronized with the triangular wave at the terminal CF and is at a high level during a rise period of the triangular wave and at a low level during a fall period of the triangular wave. The clock CK is supplied to the NAND circuit 17*a* and logic circuit 17*b*.

One end of the secondary winding S of the transformer T is connected to one electrode of a discharge lamp 3. The other electrode of the discharge lamp 3 is connected to a lamp current detector 5. A leakage inductance component of the reactor mentioned above is depicted by "Lr". The lamp current detector 5 includes diodes D1 and D2 and a resistor R4, to detect a current passed through the discharge lamp 3 and provide a voltage proportional to the detected current. This voltage is supplied through a resistor R3 and a feedback terminal FB of the control circuit 1*a* to a negative terminal of the error amplifier 15.

A gate of an n-type FET Q2 receives a burst dimming signal, a drain thereof is connected through a constant current source CC1 to the power source REG, and a source thereof is grounded. The drain of the n-type FET Q2 is also connected through diodes D3 and D4 to an emitter of a transistor Q3. The drain of the n-type FET Q2 is also connected through a diode D5 and resistors R7 and R8 to the negative terminal of the error amplifier 15. A connection point between the resistors R7 and R8 is connected to a base of a transistor Q4. The other end of the resistor R7 is connected to a collector of the transistor Q4 and the other end of the resistor R8 is connected to an emitter of the transistor Q4.

A collector of the transistor Q3 is grounded and a base thereof is connected to a connection point of resistors R5 and R6 and a positive terminal of the error amplifier 15. The other end of the resistor R5 is connected to the power source REG and the other end of the resistor R6 is grounded. An output terminal of the error amplifier 15 is connected to an anode of a Zener diode ZD1. A cathode of the Zener diode ZD1 is connected to the power source REG.

The Zener diode ZD1 works as a first clamp circuit 19*a*. The transistors Q3 and Q4, resistors R7 and R8, and diodes D3 to D5 work as a second clamp circuit 19*b*.

The output terminal of the error amplifier 15 is connected to positive terminals of the PWM comparators 16*a* and 16*b*.

The PWM comparator 16*a* provides the NAND circuit 17*a* with a pulse signal that takes a high level if an error voltage FBOUT supplied from the error amplifier 15 to the positive terminal of the PWM comparator 16*a* is equal to or higher than the voltage of the triangular signal supplied from the terminal CF to the negative terminal of the PWM comparator 16*a* and takes a low level if the error voltage FBOUT is below the voltage of the triangular signal.

The PWM comparator 16*b* provides the logic circuit 17*b* with a pulse signal that takes a high level if the error voltage FBOUT supplied from the error amplifier 15 to the positive terminal of the PWM comparator 16*b* is equal to or higher than the voltage of an inverted signal of the signal supplied from the triangular wave generator 12 to the negative terminal of the PWM comparator 16*b* and takes a low level if the error voltage FBOUT is below the voltage of the inverted signal. The inverted signal is formed by inverting the triangular signal with respect to a midpoint potential of the upper limit value VH and lower limit value VL of the triangular signal.

The NAND circuit 17*a* carries out a NAND operation of the clock CK from the triangular wave generator 12, the signal from the PWM comparator 16*a*, and the burst dimming signal BURST and supplies a first drive signal to the p-type FET Qp1 through the driver 18*a* and terminal DRV1. The logic circuit 17*b* carries out an AND operation of an inverted signal of the clock CK from the triangular wave generator 12, the signal from the PWM comparator 16*b*, and the burst dimming signal BURST and supplies a second drive signal to the n-type FET Qn1 through the driver 18*b* and terminal DRV2.

The first drive signal provided by the PWM comparator 16*a*, NAND circuit 17*a*, and driver 18*a* drives the p-type FET Qp1 in such a way as to pass a current to the discharge lamp 3 with a pulse width corresponding to a current passed through the discharge lamp 3 within an interval shorter than a half period of the triangular signal. The second drive signal provided by the PWM comparator 16*b*, logic circuit 17*b*, and driver 18*b* has substantially the same pulse width as the first drive signal and a phase difference of about 180 degrees with respect to the first drive signal and drives the n-type FET Qn1 in such a way as to pass a current through the discharge lamp 3 in a direction opposite to the direction of the current passed according to the first drive signal.

Characteristic Part of the First Embodiment

Figure 4:
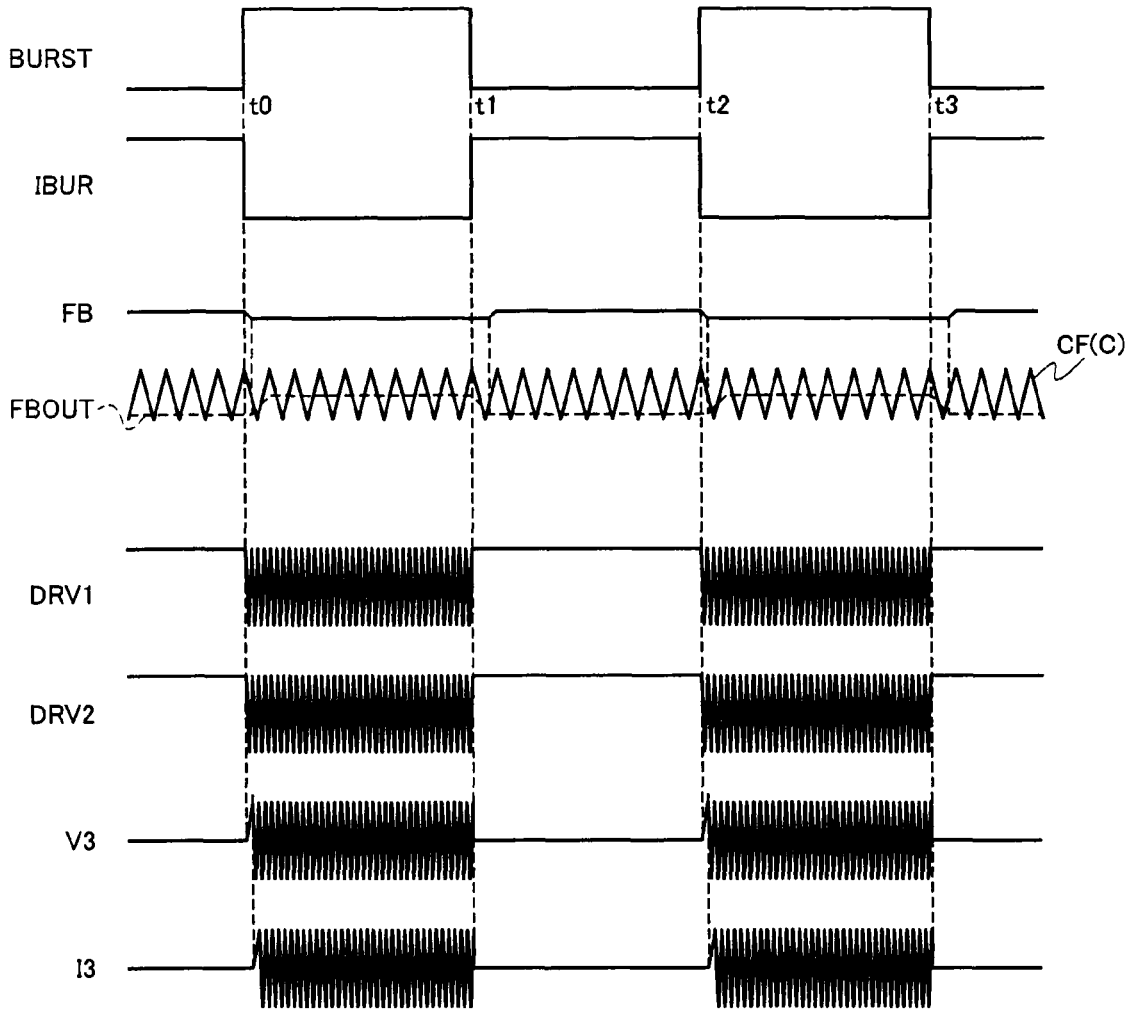
FIG. 4 is a view showing waveforms during a burst dimming operation of the apparatus according to the first embodiment shown in FIG. 3.

Characteristic part of the first embodiment and operation thereof will be explained with reference to the waveforms shown in FIG. 4.

By properly setting a breakdown voltage, the Zener diode ZD1 of the first clamp circuit 19*a* can clamp the output FBOUT of the error amplifier 15 so that the output FBOUT may not drop below the lower limit value of the triangular signal CF even during an OFF period (for example, from t1 to t2) of a burst dimming operation.

During the OFF period of the burst dimming operation, the second clamp circuit 19*b* increases a voltage at the negative terminal of the error amplifier 15, which conducts a soft start action, higher than a voltage at the positive terminal of the error amplifier 15, so that the output of the error amplifier 15 may reduce power supply to the discharge lamp 3. During the OFF period of the burst dimming operation, the second clamp circuit 19*b* clamps the voltage at the negative terminal of the error amplifier 15 based on the voltage at the positive terminal of the error amplifier 15 so that the negative-terminal voltage may not become excessively higher than the positive-terminal voltage.

During the OFF period of the burst dimming operation, the n-type FET Q2 is OFF, and therefore, a current passes through a path extending along REG, CC1, D3, D4, Q3, and the ground. At the same time, a current passes through a path extending along REG, CC1, D5, Q4, R3, R4, and the ground, and the voltage at the negative terminal (inverting input terminal) of the error amplifier 15 becomes higher than the voltage at the positive terminal (non-inverting input terminal) thereof. A clamp voltage that is the difference between the voltage at the negative terminal and the voltage at the positive terminal of the error amplifier 15 is determined by a ratio of the resistors R7 and R8. This clamp voltage may be 0.1 V or 0.01 V. To quickly turn on the discharge lamp 3 at each turn-on action during the burst dimming operation, it is preferable that the voltage at the negative terminal and the voltage at the positive terminal of the error amplifier 15 are as closer to each other as possible.

During an OFF period of the burst dimming operation, the PWM comparator 16*a* compares the output FBOUT of the error amplifier 15 with the lower limit value of the triangular signal CF and provides the NAND circuit 17*a* with a very short PWM control signal. Similarly, during the OFF period of the burst dimming operation, the PWM comparator 16*b* compares the output of the error amplifier 15 with the lower limit value of the inverted triangular signal and provides the logic circuit 17*b* with a very short PWM control signal.

During the OFF period of the burst dimming operation, the NAND circuit 17*a* serves as a breaking circuit to break the PWM control signal and provide the p-type FET Qp1 with a high-level signal through the driver 18*a*, to turn off the p-type FET Qp1. During the OFF period of the burst dimming operation, the logic circuit 17*b* serves as a breaking circuit to block the PWM control signal and provide the n-type FET Qn1 with a low-level signal through the driver 18*b*, to turn off the n-type FET Qn1. As a result, no power is supplied to the discharge lamp 3 during the OFF period of the burst dimming operation. Namely, the discharge lamp 3 does not receive a voltage V3 nor a current I3.

In this way, the discharge lamp lighting apparatus according to the first embodiment can speedily turn on the discharge lamp 3 from a soft start action in an ON period of a burst dimming operation and can turn on/off the discharge lamp 3 at a duty that is very close to the duty of a burst dimming signal. During an OFF period of the burst dimming operation, the apparatus of the first embodiment stops supplying power to the discharge lamp 3 to surely suppress light emission of the discharge lamp 3.

The first embodiment provides the negative terminal of the error amplifier 15 with the second clamp circuit 19*b* that clamps a voltage at the negative terminal based on a voltage at the positive terminal of the error amplifier 15. This enables the voltage at the positive terminal of the error amplifier 15 to be increased or decreased, to expand the range in which a current dimming operation is carried out. The current dimming operation may be employed together with the burst dimming operation.

During an OFF period of the burst dimming operation, the output of the error amplifier 15 may be decreased below the lower limit value of the triangular signal, to zero a PWM control signal. In this case, the p- and n-type FETs Qp1 and Qn1 must be kept off until the output of the error amplifier 15 reaches the lower limit value of the triangular signal in an ON period of the burst dimming operation. If a voltage at the negative terminal of the error amplifier 15 is excessively higher than a voltage at the positive terminal thereof during an OFF period of the burst dimming operation, the p- and n-type FETs Qp1 and Qn1 must be kept off until the voltage at the negative terminal of the error amplifier 15 returns to the voltage at the positive terminal after an ON period of the burst dimming operation starts. In each of these cases, a problem arises that the duty of a burst dimming signal disagrees with an ON/OFF duty of the discharge lamp 3. This problem never happens in the present embodiment because the second clamp circuit 19*b* of the present embodiment clamps a voltage at the negative terminal of the error amplifier 15 based on a voltage at the positive terminal thereof.

When the burst dimming signal is at a high level, the n-type FET Q2 is ON and the anodes of the diodes D5 and D3 are grounded to establish a reversely biased state. As a result, the positive terminal of the error amplifier 15 receives a divided voltage from the resistors R5 and R6 and the negative terminal of the error amplifier 15 receives a voltage from the resistor R3. Accordingly, the output FBOUT of the error amplifier 15 in the ON period (for example, from t0 to t1 or from t2 to t3) has a sufficient level necessary for PWM control to output the drive signals DRV1 and DRV2.

Second Embodiment

Figure 5:
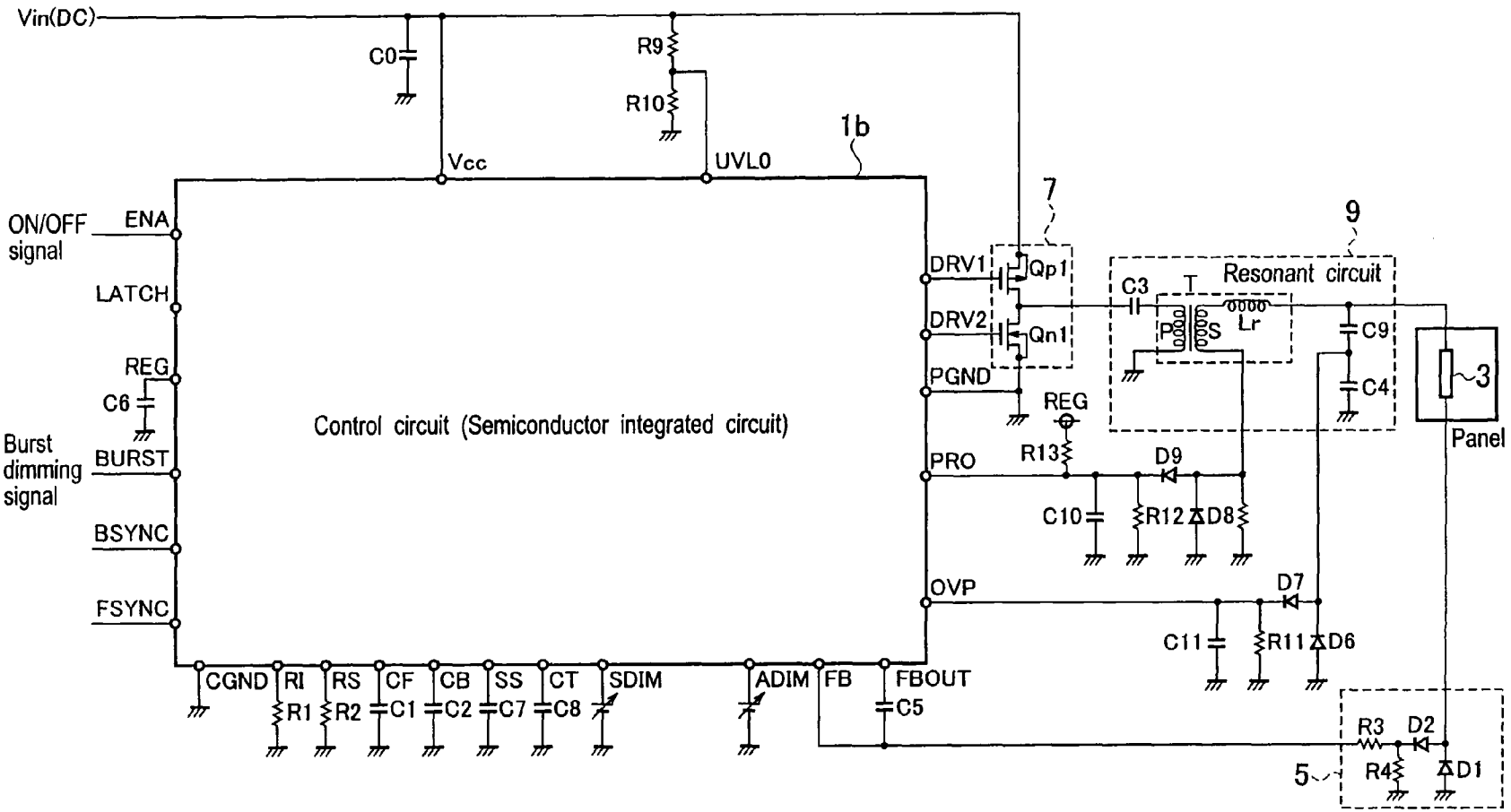
FIG. 5 is a circuit diagram showing a discharge lamp lighting apparatus according to a second embodiment of the present invention.
Figure 6:
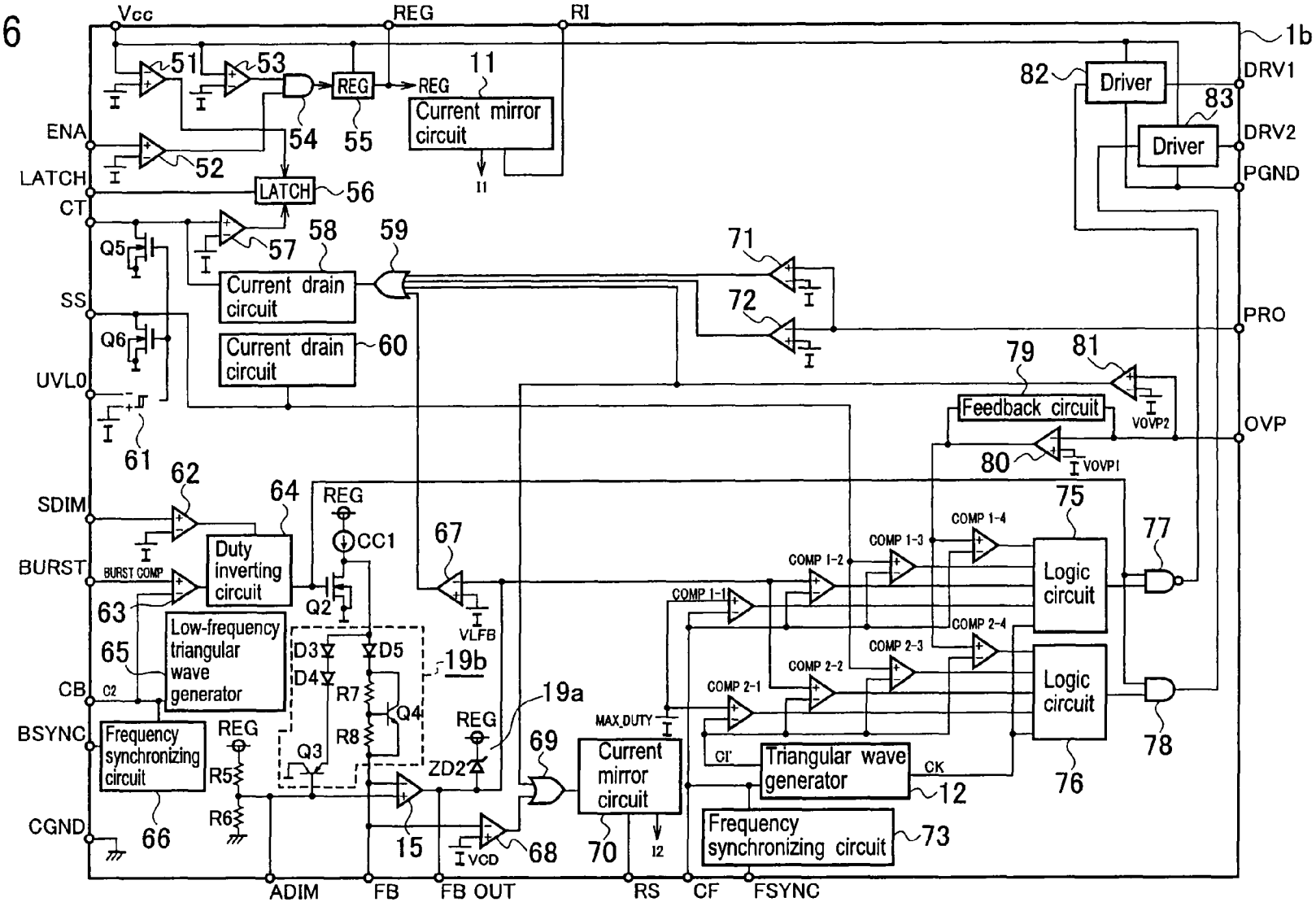
FIG. 6 is a view showing a semiconductor integrated circuit serving as a control circuit of the apparatus shown in FIG. 5.

FIG. 5 is a circuit diagram showing a discharge lamp lighting apparatus according to the second embodiment of the present invention. The apparatus according to the second embodiment is a practical example of the present invention. FIG. 6 is a view showing a semiconductor integrated circuit serving as a control circuit in the apparatus of FIG. 5.

An end of a secondary winding S of a transformer T is connected to diodes D8 and D9, resistors R12, R13, and R14, and a capacitor C10 that rectify and smooth a voltage generated by the secondary winding S and supply the rectified-and-smoothed voltage to a terminal PRO of the control circuit 1*b*.

A divided voltage at a branch circuit of Capacitors C9 and C4 is rectified and smoothed through diodes D6 and D7, a resistor R11, and a capacitor C11 and the rectified-and-smoothed voltage is supplied to a terminal OVP of the control circuit 1*b*.

Parts other than the control circuit 1*b* of the discharge lamp lighting apparatus of FIG. 5 are the same as those of the apparatus shown in FIG. 3, and therefore, the same parts are represented with like reference numerals and are not explained in detail.

Operation of the discharge lamp lighting apparatus according to the second embodiment will be explained with reference to FIGS. 5 and 6.

A voltage at a terminal Vcc is supplied to a comparator 53 that defines a start voltage. A voltage at a terminal ENA is supplied to a comparator 52 that defines the start voltage. When the voltages at the terminals Vcc and ENA exceed respective threshold voltages, an AND circuit 54 provides a high-level output to activate an internal regulator 55, which supplies a voltage at a terminal REG to various parts.

If the voltage at the terminal ENA is lower than the predetermined voltage, the AND circuit 54 blocks the voltage at the terminal Vcc and the internal regulator 55 nearly zeroes a current consumed by the control circuit (IC) 1*b* in a standby state.

When the internal regulator 55 is activated, parts in the control circuit 1*b* start to operate. This will be explained in detail.

A terminal RI is connected to a resistor R1 for constant current determination that optionally determines a current I1 provided by a current mirror circuit 11. A terminal RS is connected to a resistor R2 for constant current determination that optionally determines a current I2 provided by a current mirror circuit 70. The sum of the currents I1 and I2 charges and discharges an oscillator capacitor C1 connected to a terminal CF, thereby generating a triangular signal whose rise and fall angles are equal to each other.

A current passed through a discharge lamp 3 is converted by a resistor R4 into a voltage that is supplied to a terminal FB. The voltage at the terminal FB is supplied to a comparator 68. The comparator 68 also receives a reference voltage VCD that is set to be lower than a reference voltage VREF of an error amplifier 15, the voltage VREF being provided by resistors R5 and R6 that divide the source voltage REG. If the voltage at the terminal FB is higher than the voltage VCD, the comparator 68 provides a low-level output. At this time, if the voltage at the terminal OVP is lower than a reference voltage VOVP2 of an OVP comparator 81, an OR circuit 69 provides a low-level output.

Due to the low-level output from the OR circuit 69, the current mirror circuit 70 is inoperative and does not provide the current I2. As a result, the capacitor C1 is charged and discharged only with the current I1. Namely, in an initial state until a current is passed through the discharge lamp 3, a voltage is applied to the discharge lamp 3 at a frequency higher than a steady-state frequency, to increase the gain of a series resonant circuit 9. With the higher output voltage and the proximity effect of a panel serving as a load, the second embodiment improves the turn-on characteristic of the discharge lamp 3.

The triangular signal C1 is supplied to each negative terminal of PWM comparators COMP1-1, COMP1-2, COMP1-3, and COMP1-4. An inverted signal C1' formed by inverting the triangular signal C1 at a midpoint of upper and lower limit values of the triangular signal is supplied to each negative terminal of PWM comparators COMP2-1, COMP2-2, COMP2-3, and COMP2-4.

When the voltage REG rises, a soft start capacitor C7 connected to a terminal SS is charged with a constant current. As a result, the voltage of the capacitor C7 gradually increases. The voltage of the capacitor C7 at the terminal SS is supplied to each positive terminal of the PWM comparators COMP1-3 and COMP 2-3. Each of the PWM comparators COMP1-3 and COMP2-3 compares the voltages supplied to the positive and negative terminals thereof with each other and provides a pulse voltage accordingly.

An output from a lamp current detector 5 is connected to the terminal FB that is connected to a negative terminal of the error amplifier 15. An output from the error amplifier 15 is connected to a terminal FBOUT that is connected to each positive terminal of the PWM comparators COMP1-2 and COMP2-2. Each of the PWM comparators COMP1-2 and COMP2-2 compares voltages at the positive and negative terminals thereof with each other and provides a pulse voltage accordingly. A capacitor C5 connected between the terminals FB and FBOUT is a phase compensator of the error amplifier 15.

An output voltage of the discharge lamp lighting apparatus is divided by the capacitors C9 and C4, is rectified and smoothed, and is supplied to the terminal OVP. The voltage to the terminal OVP is amplified by an amplifier 80. The amplified voltage is supplied to each positive terminal of the PWM comparators COMP1-4 and COMP2-4. Each of the PWM comparators COMP1-4 and COMP2-4 compares the voltages at the positive and negative terminals thereof with each other and provides a pulse voltage accordingly.

Each of the PWM comparators COMP1-1 and COMP2-1 determines a maximum ON duty. Namely, each of these PWM comparators receives, at the positive terminal thereof, a maximum duty voltage MAX_DUTY that is set to be slightly lower than an upper limit voltage of the triangular signal C1, compares the voltages at the positive and negative terminals thereof with each other, and provides a pulse voltage accordingly.

A logic circuit 75 selects one having a shortest pulse width from among the output pulse voltages of the PWM comparators COMP1-1, COMP1-2, COMP1-3, and COMP1-4, and only during a rise period of the triangular signal C1, sends the selected output pulse voltage through a NAND circuit 77 and a driver 82 to a terminal DRV1.

A logic circuit 76 selects one having a shortest pulse width from among the output pulse voltages of the PWM comparators COMP2-1, COMP2-2, COMP2-3, and COMP2-4, and only during a rise period of the inverted signal C1', sends the selected output pulse voltage through an AND circuit 78 and a driver 83 to a terminal DRV2.

Through the operation mentioned above, the discharge lamp lighting apparatus of the second embodiment turns on/off p- and n-type FETs Qp1 and Qn1 alternately at the frequency of the triangular signal C1, to supply power to the discharge lamp 3. At the same time, the apparatus controls a current passed through the discharge lamp 3 to a predetermined value by conducting feedback control on the error amplifier 15. If the output terminal of the discharge lamp lighting apparatus is open, the voltage at the terminal OVP increases to the reference voltage VOVP1 of the amplifier 80. Then, the feedback control of the amplifier 80 controls the open output voltage of the discharge lamp lighting apparatus to a predetermined value.

If the voltage at the terminal OVP exceeds the reference voltage VOVP2 when the output of the discharge lamp lighting apparatus is open, the comparator 81 provides an OR circuit 59 with a high-level signal. Then, the OR circuit 59 provides a high-level output. In response to this, a current detection circuit 58 detects a current. As a result, a timer capacitor C8 connected to a terminal CT is charged with a constant current, to gradually increase the voltage of the capacitor C8. If the output of the discharge lamp lighting apparatus is short-circuited to the ground GND, the current passed through the discharge lamp 3 becomes zero. As a result, the voltage at the negative terminal of the error amplifier 15 becomes nearly the ground voltage, to increase the output of the error amplifier 15. When the voltage at the terminal FBOUT exceeds a value VLFB, a comparator 67 provides the OR circuit 59 with a high-level signal. Through the OR circuit 59 and current detection circuit 58, the timer capacitor C8 connected to the terminal CT is charged with a constant current, and therefore, the voltage of the capacitor C8 gradually increases.

The terminal PRO is connected to window comparators 71 and 72. In combination with optional applications, the window comparators 71 and 72 detect various abnormal states including an over current passing through the transformer T and a low output voltage state of the discharge lamp lighting apparatus. If the voltage at the terminal PRO is higher than a threshold value of any one of the window comparators 71 and 72, the timer capacitor C8 connected to the terminal CT is charged with a constant current through the OR circuit 59 and current detection circuit 58. As a result, the voltage of the capacitor C8 gradually increases.

When the voltage at the terminal CT exceeds a threshold voltage, an amplifier 57 provides a latch circuit 56 with a high-level output, to shut down the outputs DRV1 and DRV2 of the control circuit 1*b* in a latch mode. If a normal state is restored from the abnormal state during the operation of the timer capacitor C8, the timer capacitor C8 is discharged. If the voltage at the terminal Vcc decreases below a latch release voltage, a comparator amplifier 51 provides the latch circuit 56 with a high-level output, to release the latch mode.

A terminal LATCH is at a high level during a normal operation. When the control circuit 1*b* is put in the latch mode, the terminal LATCH changes to a low level to inform other control circuits and systems of an abnormal state.

A burst dimming operation will be explained. Based on the constant current determination resistor R1 connected to the terminal RI, the current mirror circuit 11 optionally sets the current I1. According to the current I1, a low-frequency-oscillation capacitor C2 connected to a terminal CB is charged and discharged to generate a low-frequency triangular signal whose rise angle and fall angle are equal to each other.

A burst dimming comparator 63 compares the voltage of the capacitor C2 at the terminal CB with an input voltage from a terminal BURST, and if the voltage at the terminal BURST is lower than the voltage of the capacitor C2, supplies a low-level output to a gate of an n-type FET Q2. Since the n-type FET Q2 is OFF, a current passes through a path extending along REG, CC1, D5, Q4, R3, R4, and the ground. Namely, the current passes through the terminal FB, to set the voltage at the negative terminal of the error amplifier 15 to a voltage that is determined by a clamp circuit 19*b* and is slightly higher than the voltage at the positive terminal of the error amplifier 15. Thus, the output FBOUT of the error amplifier 15 operates to reduce power to be supplied to the discharge lamp 3.

At the same time, a Zener diode ZD2 serving as a first clamp circuit 19*a* clamps the output FBOUT of the error amplifier 15 so that the output FBOUT may not decrease below the lower limit value of the triangular signal. The PWM comparators COMP1-2 and COMP2-2 are in a standby state in which they are ready to provide very-short PWM control signals. The NAND circuit 77 and AND circuit 78 block PWM control signals, thereby stopping outputs of oscillations. In this way, when the voltage at the terminal BURST is a pulse signal exceeding the upper and lower limit values of the capacitor C2 or a DC voltage within the upper and lower limit values of the capacitor C2, the second embodiment passes a pulse current out of the terminal FB, to intermittently provide oscillation outputs, reduce power supply, and perform the burst dimming operation.

At the start of an ON period of the burst dimming operation, the error amplifier 15 operates as an integrator in combination with the capacitor C5 and resistors R3 and R4, so that the output voltage of the error amplifier 15 may gradually increase. As a result, the voltage and current of the discharge lamp 3 gradually increase. With this, the discharge lamp 3 can quickly turn on from a soft start action that prevents an excessive stress on the discharge lamp 3.

A terminal SDIM can reverse ON and OFF periods of the burst dimming operation. When a voltage at the terminal SDIM is low, an amplifier 62 outputs a low-level signal to a duty inverting circuit 64. During a period in which the voltage at the terminal BURST is higher than the voltage of the capacitor C2, the comparator 63 outputs a high-level signal to turn on the n-type FET Q2 and provide an oscillation output. During a period in which the voltage at the terminal BURST is lower than the voltage of the capacitor C2, the comparator 63 outputs a low-level signal to turn off the n-type FET Q2 to stop the output of the oscillation.

If the voltage at the terminal SDIM is high, the amplifier 62 outputs a high-level signal to the duty inverting circuit 64. During a period in which the voltage at the terminal BURST is higher than the voltage of the capacitor C2, the comparator 63 outputs a high-level signal that is inverted by the duty inverting circuit 64 into a low-level signal to turn off the n-type FET Q2 and stop the oscillation output. During a period in which the voltage at the terminal BURST is lower than the voltage of the capacitor C2, the comparator 63 outputs a low-level signal that is inverted by the duty inverting circuit 64 into a high-level signal to turn on the n-type FET Q2 and provide the oscillation output.

If a plurality of discharge lamp lighting apparatuses are used to turn on the discharge lamp 3, the capacitors of the apparatuses will commonly be connected to synchronize the burst dimming frequencies and phases of the apparatuses with one another. In this case, the number of the capacitors C2 may be equal to the number of the discharge lamp lighting apparatuses, or may be one that may provide combinational capacitance.

A terminal ADIM is connected to the positive terminal of the error amplifier 15. With the use of a variable voltage supplied to the terminal ADIM, the reference voltage of the error amplifier 15 is variable to widen the range of current dimming.

A terminal UVLO is connected to a hysteresis comparator 61. If a voltage at the terminal UVLO is equal to or lower than a predetermined voltage, the hysteresis comparator 61 turns on an n-type FET Q5 so that the amplifier 57 may output a low-level signal to the latch circuit 56 to block signals to the latch circuit 56. At the same time, a terminal SS is set to a low level to cut off the outputs of the control circuit lb. When the voltage at the terminal UVLO exceeds the predetermined voltage, the signal to set the terminal SS to the low level is released and the outputs of the control circuit 1*b* are resumed from a soft start action. By applying a voltage proportional to the source voltage of the discharge lamp lighting apparatus to the terminal UVLO, an under voltage lockout operation can be performed for the source voltage of the discharge lamp lighting apparatus.

A terminal FSYNC is an external synchronizing signal input terminal and is connected to a frequency synchronizing circuit 73. At the frequency of a pulse signal from the frequency synchronizing circuit 73, the triangular signal C1 oscillates. A terminal BSYNC is an external synchronizing signal input terminal and is connected to a frequency synchronizing circuit 66. At the frequency of a pulse signal from the frequency synchronizing circuit 66, the triangular signal C2 oscillates. A terminal PGND is for grounding the output drivers 82 and 83. A terminal CGND is for grounding parts of the control circuit 1*b* other than the output drivers 82 and 83.

The discharge lamp lighting apparatus according to the second embodiment provides the same effect as the discharge lamp lighting apparatus of the first embodiment.

Third Embodiment

Figure 7:
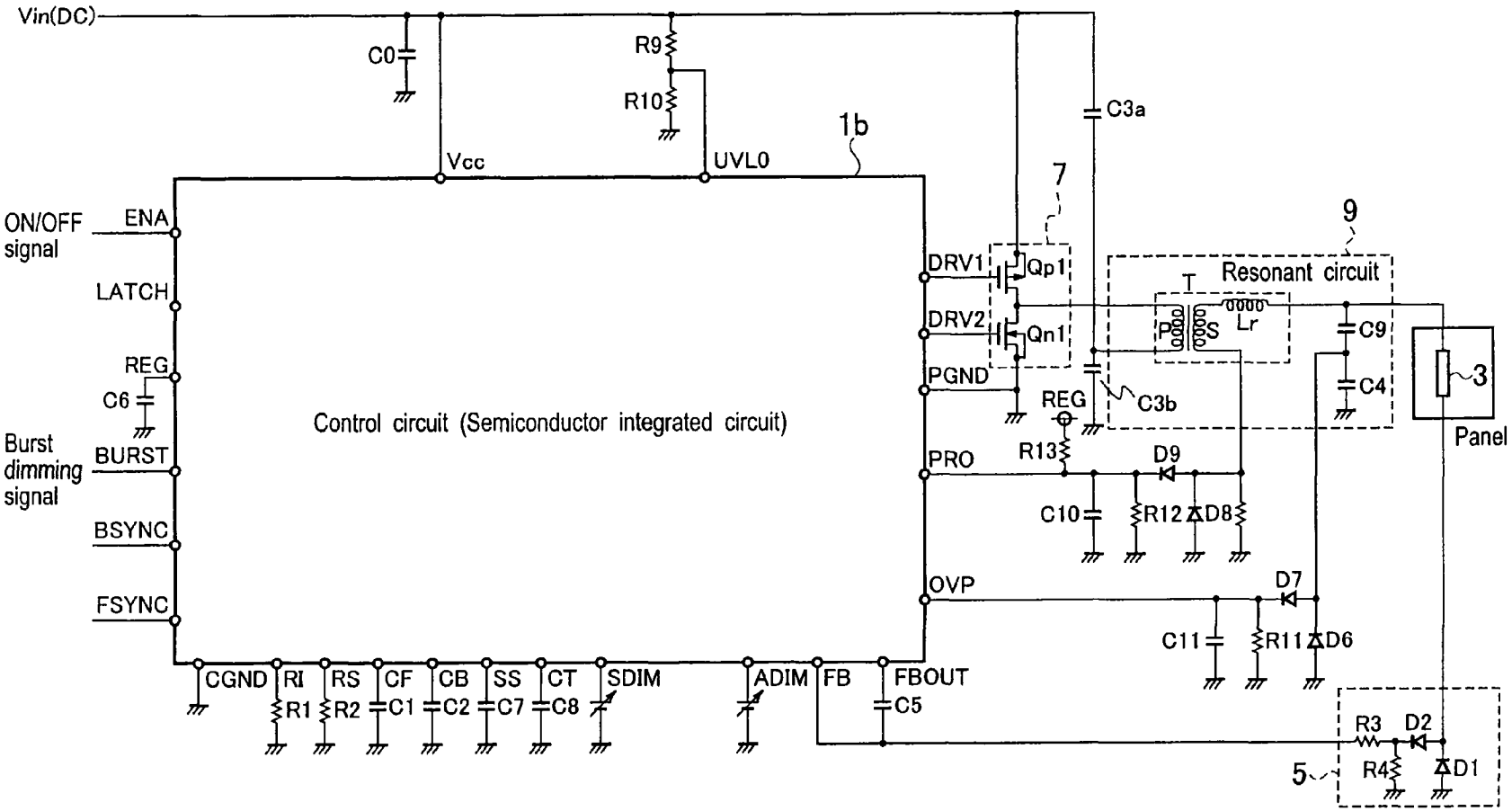
FIG. 7 is a circuit diagram showing a discharge lamp lighting apparatus according to a third embodiment of the present invention.

FIG. 7 is a circuit diagram showing a discharge lamp lighting apparatus according to the third embodiment of the present invention. The apparatus according to the third embodiment divides the capacitor C3 of the discharge lamp lighting apparatus of the second embodiment into capacitors C3*a* and C3*b*. Namely, the third embodiment removes the capacitor C3 of the second embodiment and connects a series circuit of the capacitors C3*a* and C3*b* between a power source Vin and the ground. In addition, the third embodiment connects a connection point of the capacitors C3*a* and C3*b* to one end of a primary winding P of a transformer T.

The third embodiment provides the same effect as the second embodiment.

Fourth Embodiment

Figure 8:
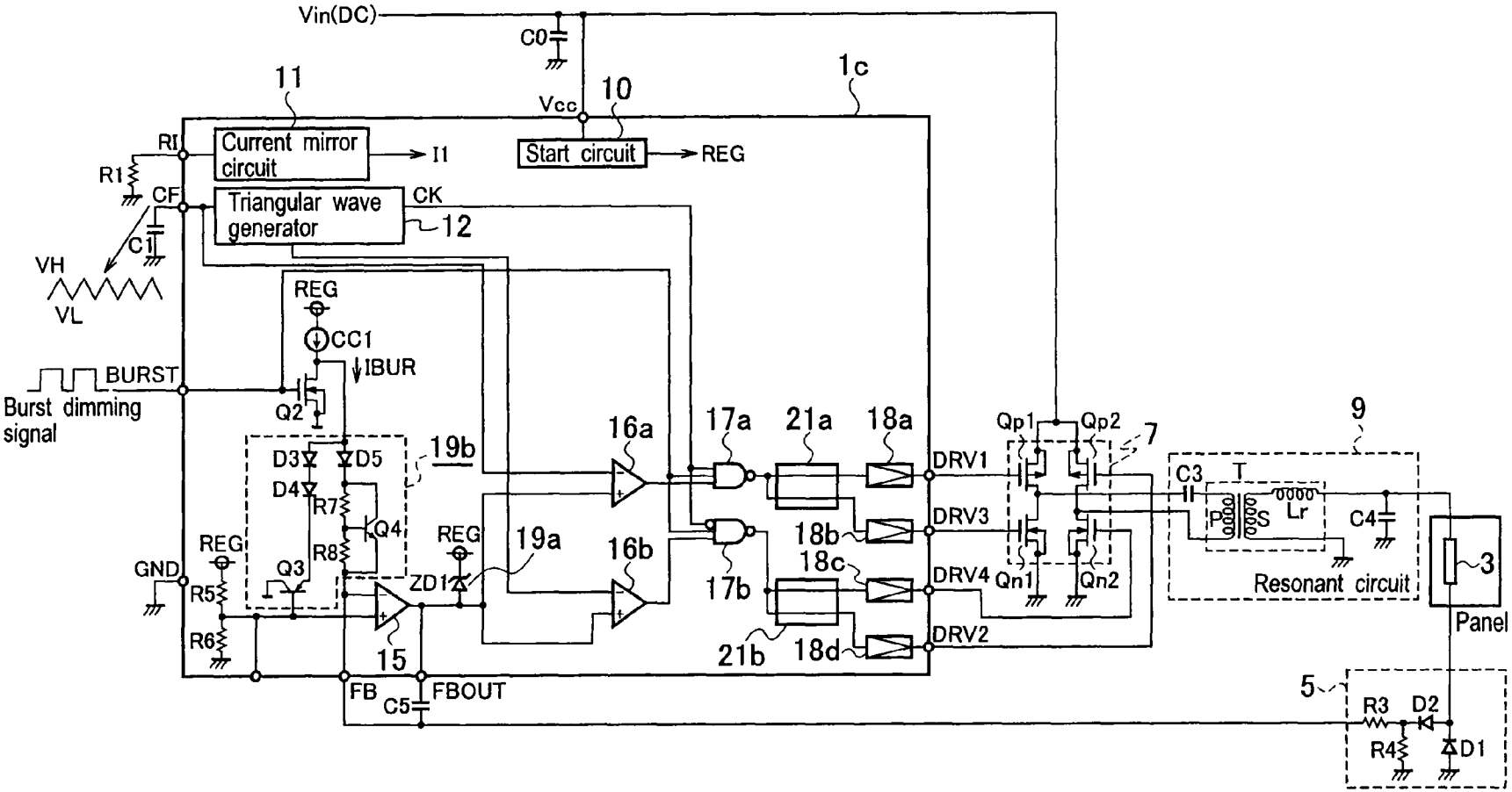
FIG. 8 is a circuit diagram showing a discharge lamp lighting apparatus according to a fourth embodiment of the present invention.

FIG. 8 is a circuit diagram showing a discharge lamp lighting apparatus according to the fourth embodiment of the present invention. The apparatus shown in FIG. 8 employs a full-bridge circuit. Compared with the control circuit 1*a* according to the first embodiment as shown in FIG. 3, a control circuit 1*c* according to the fourth embodiment shown in FIG. 8 employs dead time generators 21*a* and 21*b* and drivers 18*a* to 18*d*.

Between a DC power source Vin and the ground, there is connected a series circuit (switch network) 7 including a high-side p-type FET Qp2 and a low-side n-type FET Qn2. Between a connection point of p- and n-type FETs Qp1 and Qn1 and a connection point of the p- and n-type FETs Qp2 and Qn2, there is connected a series circuit including a capacitor C3 and a primary winding P of a transformer T.

An output of the driver 18*a* is connected through a terminal DRV1 to a gate of the p-type FET Qp1. An output of the driver 18*b* is connected through a terminal DRV3 to a gate of the n-type FET Qn1. An output of the driver 18*c* is connected through a terminal DRV4 to a gate of the n-type FET Qn2. An output of the driver 18*d* is connected through a terminal DRV2 to a gate of the p-type FET Qp2.

Based on a signal from a NAND circuit 17*a*, the dead time generator 21*a* provides the driver 18*b* with a third drive signal DRV3 that has a predetermined dead time DT relative to a first drive signal DRV1 to the driver 18*a*. Based on a signal from a logic circuit 17*b*, the dead time generator 21*b* provides the driver 18*d* with a second drive signal DRV2 that has a predetermined dead time DT relative to a fourth drive signal DRV4 to the driver 18*c*.

The first and third drive signals have the dead time DT so that the first and third drive signals may not simultaneously rise to an ON level. The second and fourth drive signals have the dead time DT so that the second and fourth drive signals may not simultaneously rise to an ON level. Except the dead time DT, the third drive signal is substantially equal to the first drive signal and the fourth drive signal is substantially equal to the second drive signal.

The discharge lamp lighting apparatus employing the full-bridge circuit according to the fourth embodiment provides the same operation and effect as the apparatus of the first embodiment.

The present invention is not limited to the discharge lamp lighting apparatuses of the first to fourth embodiments. For example, a phase difference between drive signals may not perfectly be equal to 180 degrees if the symmetry of currents passed through the discharge lamp 3 is not greatly deteriorated. The triangular wave generator 12 may be a sawtooth-wave oscillator.

As explained above, in the discharge lamp lighting apparatus and semiconductor integrated circuit according to the present invention, the first clamp circuit clamps an output from the error amplifier so that the output of the error amplifier may not drop below the lower limit value of the triangular signal during an OFF period of a burst dimming signal. The apparatus and semiconductor integrated circuit put the comparators in a standby state so that the comparators may be ready to output very short PWM control signals. The breaking circuit blocks the PWM control signals during the OFF period of the burst dimming signal. At the start of an ON period of the burst dimming signal, the apparatus and semiconductor integrated circuit can quickly turn on the discharge lamp from a soft start action and can turn on/off the discharge lamp at a duty close to the duty of the burst dimming signal. During an OFF period of the burst dimming signal, the apparatus and semiconductor integrated circuit can stop the supply of power to the discharge lamp, to surely suppress light emission from the discharge lamp.

According to the present invention, the second clamp circuit sets a voltage at one input terminal of the error amplifier to be slightly higher than a voltage at the other input terminal thereof during the OFF period of the burst dimming signal, so that an output from the error amplifier may operate to reduce power supply to the load (discharge lamp) and so that power supply to the load may quickly be resumed from a soft start action at the start of an ON period of the burst dimming signal.

This application claims benefit of priority under 35USC §119 to Japanese Patent Applications No. 2007-072655, filed on Mar. 20, 2007, the entire contents of which are incorporated by reference herein. Although the invention has been described above by reference to certain embodiments of the invention, the invention is not limited to the embodiments described above. Modifications and variations of the embodiments described above will occur to those skilled in the art, in light of the teachings. The scope of the invention is defined with reference to the following claims.

What is claimed is:

1. A discharge lamp lighting apparatus for converting a direct current into an alternating current and supplying power to a discharge lamp, comprising:

a resonant circuit including a transformer, a capacitor connected to at least one of primary and secondary windings of the transformer, and an output end connected to the discharge lamp;

a plurality of switching elements connected to both ends of a direct-current power source and configured to pass a current through the primary winding and capacitor of the resonant circuit;

an oscillator configured to generate a triangular signal;

an error amplifier configured to amplify an error voltage between a reference voltage and a voltage corresponding to a current passed through the discharge lamp and receive a burst dimming signal that is a pulse signal to intermittently supply power to the discharge lamp;

comparators configured to generate PWM control signals to turn on/off the switching elements, respectively, according to the error voltage from the error amplifier and the triangular signal from the oscillator;

a first clamp circuit configured to clamp an output from the error amplifier so that the output from the error amplifier may not drop below a lower limit value of the triangular signal during an OFF period of the burst dimming signal; and breaking circuits configured to block the PWM control signals provided by the comparators during the OFF period of the burst dimming signal.

2. The discharge lamp lighting apparatus of claim 1, further comprising:

a second clamp circuit configured to set a voltage applied to one input terminal of the error amplifier to be slightly higher than a voltage applied to the other input terminal of the error amplifier during the OFF period of the burst dimming signal.

3. A semiconductor integrated circuit for controlling a plurality of switching elements that supply power to a discharge lamp, comprising:

an oscillator configured to generate a triangular signal;

an error amplifier configured to amplify an error voltage between a reference voltage and a voltage corresponding to a current passed through the discharge lamp and receive a burst dimming signal that is a pulse signal to intermittently supply power to the discharge lamp;

comparators configured to generate PWM control signals to turn on/off the switching elements, respectively, according to the error voltage from the error amplifier and the triangular signal from the oscillator;

a first clamp circuit configured to clamp an output from the error amplifier so that the output from the error amplifier may not drop below a lower limit value of the triangular signal during an OFF period of the burst dimming signal; and breaking circuits configured to block the PWM control signals provided by the comparators during the OFF period of the burst dimming signal.

4. The semiconductor integrated circuit of claim 3, further comprising:

a second clamp circuit configured to set a voltage applied to one input terminal of the error amplifier to be slightly higher than a voltage applied to the other input terminal of the error amplifier during the OFF period of the burst dimming signal.

* * * * *